United States Patent [19]

Carmes

[11] Patent Number: 4,896,850

[45] Date of Patent: Jan. 30, 1990

[54] RAILROAD SWITCH MOTOR SYSTEM

[75] Inventor: Francis Carmes, Voisins le Bretonneux, France

[73] Assignee: Societe Anonyme dite: ALSTHOM, Cedex, France

[21] Appl. No.: 271,787

[22] Filed: Nov. 16, 1988

[30] Foreign Application Priority Data

Nov. 23, 1987 [FR] France ..... 87 16189

[51] Int. Cl.[4] ..... B61L 5/10; B61L 11/02

[52] U.S. Cl. ..... 246/476; 246/344; 246/401

[58] Field of Search ..... 246/277, 278, 280, 290, 246/291, 300, 301, 314, 326, 334, 344, 350, 401, 402, 416, 420, 435 R, 439, 448, 452, 476; 104/195

[56] References Cited

U.S. PATENT DOCUMENTS

| | | | |
|---|---|---|---|
| 1,247,447 | 11/1917 | Petty | 246/406 |
| 1,919,272 | 7/1933 | Caruso | 246/476 |
| 4,093,163 | 6/1978 | Larsson | 246/476 |
| 4,845,225 | 6/1989 | Carmes | 246/439 |

FOREIGN PATENT DOCUMENTS

| | | | |
|---|---|---|---|
| 1010555 | 6/1957 | Fed. Rep. of Germany | 246/401 |
| 1098980 | 2/1961 | Fed. Rep. of Germany | 246/452 |
| 2713561 | 10/1978 | Fed. Rep. of Germany | 246/334 |
| 621168 | 1/1981 | Fed. Rep. of Germany . | |
| 2029050 | 10/1970 | France . | |
| 2338832 | 8/1977 | France . | |
| 0493825 | 10/1938 | United Kingdom | 246/291 |

*Primary Examiner*—Andres Kashnikow
*Assistant Examiner*—Timothy Newholm
*Attorney, Agent, or Firm*—Sughrue, Mion, Zinn, Macpeak & Seas

[57] ABSTRACT

The system includes a motor and stepdown gear unit (17) which drives a central body (22) of a moving equipment longitudinally by means of a ball screw (20) and a nut. The moving equipment includes two slides (24, 25) sandwiching the central body (22). The two slides mesh with a common gear wheel mounted to rotate freely in the central body (22). Each of the slides drives a corresponding control bar (9, 10) connected to an operating rod (7, 8) in turn connected to one of the blades of a railroad switch, with said drive taking place via a vertical cylindrical floating peg (34, 35, 38, 39). The control bars (9, 10) are locked at the ends of the stroke of the central body (22) by respective ones of the floating pegs being positioned in a corresponding locking groove (40 to 43) of a fixed locking plate (30, 31). Any mechanical fault in the transmission linkage gives rise to relative displacement between the slides (24, 25) about the central body (22) and this is detected by the common gear wheel rotating, said gear wheel being fixed to means (27) for actuating a contact (29) for indicating anomalous operation.

10 Claims, 10 Drawing Sheets

RAILROAD SWITCH MOTOR SYSTEM

The present invention relates to a motor system for a railroad switch or point.

BACKGROUND OF THE INVENTION

Several systems of operating and locking mechanisms for railroad switches or "points" exist in various different countries and depending on the functions that are to be performed, in particular on whether the switch is capable of being burst open or "trailed". A switch which is capable of being trailed is one which, when used as a trailing switch, i.e. when approached from the direction having two tracks leading to a single track, passes traffic, without damage, coming from the track which does not correspond to the direction in which the switch is set, with the switch then being displaced by axle thrust. When a switch is approached by traffic coming from the single track and going towards one of the plurality of different tracks, the switch is said to be a facing switch. A switch includes two moving blades, referred to as a right point blade and as a left point blade. The terms "right" and "left" correspond to the positions of the point blades as seen when the switch is approached as a facing switch. One of the blades touches its corresponding backing rail, while the other blade is at a distance from its backing rail.

French switches are not trailable, whereas the switches on German lines are trailable. French switches which are used as trailing switches only or which are used as facing switches at speeds not exceeding 40 km/h, have a motor system including an guide plate and drive wheel system internal to the motor for locking the switch in each of its two positions. For switches used as facing switches at speeds in excess of 40 km/h, French railways make use, in addition, of an external, direct-action locking system for each blade individually, with such locking systems being known in France as "carter-coussinet" locks. These systems have only one drive rod actuating both the right and the left point blades.

German switches are trailable. One prior operating mechanism with internal locking includes an outlet shaft provided with two special gear wheels each meshing with the rack of a corresponding drive rod.

One of the drive rods is connected to the right point blade and the other is connected to the left point blade. The touching blade is locked by means of a locking bar which penetrates, at the end of outlet shaft rotation and at the end of drive rod displacement, in a notch provided in the drive rod of the touching blade. The mechanism is reversible when trailed, by acting on the non-locked non-touching blade which is held in place by a force from a torque limiter.

In addition to providing mechanisms for operating and locking a switch, it is also necessary for safety purposes to check the actual positions of the blades at the end of a switching operation.

In France, this checking is performed by checking devices fixed on the blades themselves for switches which are used solely as trailing switches. For switches that may be used as facing switches and including the so-called "carter-coussinet" locking system, the locking system itself includes devices for checking the presence and the locking of the touching blade.

In other countries, a known system consists in operating and locking the blades by two bars each fixed to one blade, with the two blades being interconnected by a spacer bar and with the position of the blades being checked by means of two other bars which convey position information to a checking device which may be integrated in the motor or otherwise.

In this case, the switch has a four-bar motor-and-checking unit, whereas in France the switch has a motor with an internal locking system using a guide plate and a drive wheel, plus external locking by means of "carter-coussinet" locks, plus the checking devices.

The object of the present invention is to provide a point motor system capable of performing all the required functions with intrinsic safety by means of two bars only, and providing a greater degree of safety than the present French system using "carter-coussinet" locks together with checking devices. The proposed motor system is also simpler and cheaper than said prior system and than foreign four-bar systems.

The invention is applicable to a railroad switch which is not trailable and which has two locked blades.

SUMMARY OF THE INVENTION

The invention thus provides a motor system for a railroad switch constituted by two moving blades: a right point blade and a left point blade, said two blades being interconnected in the vicinity of their tips by a spacer bar, the right point blade being connected in the vicinity of its tip to a right operating rod, the left point blade being connected in the vicinity of its tip to a left operating rod, the system including motor means for longitudinally driving a right control bar and a left control bar which are respectively connected to and in line with the right operating rod and the left operating rod, said motor means and said control bars being disposed in a housing disposed in a fixed position, wherein the system includes, inside said housing, moving equipment including a central body lying between a right longitudinal slide and a left longitudinal slide, the two slides meshing with a common gear wheel mounted to rotate freely in said central body, the strokes of the two slides relative to said central body being limited by abutments, said motor means acting on said central body of the moving equipment, which body is movable in parallel between a right locking plate and a left locking plate which are fixed and which are parallel to each other and to the axes of said control bars, the right control bar being situated between the right locking plate and said moving equipment by being at least partially received in said right longitudinal slide, the left control bar being situated between the left locking plate and said moving equipment by being at least partially received in said left longitudinal slide, each control bar being provided with two drive and locking pegs, which pegs are cylindrical, and disposed vertically in a floating mount, each being received between a locking plate and a slide in a notch provided in a corresponding one of the control bars, each locking plate including two vertical locking grooves having sloping side walls which flare apart going from the plate towards the bar, and having a depth of not more than one half the diameter $\frac{1}{2}D$ of one of said floating pegs, wherein the width of said moving equipment constituted by the distance between the outer flanks of the two sides, between the two locking plates is staged over three distinct widths comprising, at each end, a first stage of width no greater than the distance L between the two locking plates less twice the diameter D of a floating peg, followed on each side of said moving equipment going towards the middle of the moving equipment by a second stage of width lying between L - 2D and L - D, and finally a central stage of width less than L and greater than the width of said second stage, with the transition from the first stage to the second stage being formed by a sloping wall, the distance between the two notches of a control bar being not less than the length of the central stage plus twice the width of one of second stages, and being less than the length of the central stage plus the length of one of the second stages plus the length of one of the first stages, and wherein said common gear wheel is connected to detector means which co-operate with an electrical contact for checking anomalous operation causing said gear wheel to rotate, thereby indicating a fault.

Each floating peg may include a running wheel at each of its ends and co-operating, outside said grooves by running over the adjacent locking plate.

Each locking plate may include an anti-overrun abutment for said floating peg in the immediate vicinity of each of said grooves, and downstream therefrom relative to the direction of displacement of the moving equipment towards said groove.

Advantageously, said motor means comprise a ball screw co-operating with a nut which is fixed to said central body of said moving equipment, the ball screw being rotated by a motor and stepdown gear unit via a torque limiter.

Advantageously, said means for detecting rotation of said common gear wheel comprise a ring fixed to rotate with said common gear wheel, said ring having said ball screw passing therethrough and having an opening which is large enough relative to the diameter of the screw to allow the ring a certain amount of freedom to rotate with the gear wheel.

In a first embodiment, the said ring carries a lateral level co-operating via a slide with a rod running parallel to said screw and to said control bar, said rod being fixed at each of its ends to the end of a rocker which is hinged at its other end to said housing, with one of the two rockers including a cam co-operating with at least one switch situated in a fixed position, said slide sliding freely over said rod and being engaged in a fork at the end of said lateral lever.

In a preferred embodiment of the invention, the top portion of the ring includes a cam which co-operates with at least one contact fixed on a nut cage for the nut of the ball screw, said cage being fixed to said central body, with the information provided by said contact being conveyed to a fixed terminal strip which is fixed to said housing via a tape of conductors, said tape being protected by a fixed bottom trough which is connected to the housing and by a sliding top trough whose concave face is directed downwards and which is fixed to said central body.

BRIEF DESCRIPTION OF THE DRAWINGS

Embodiments of the invention are described by way of example with reference to the accompanying drawings, in which.

Figure 7:
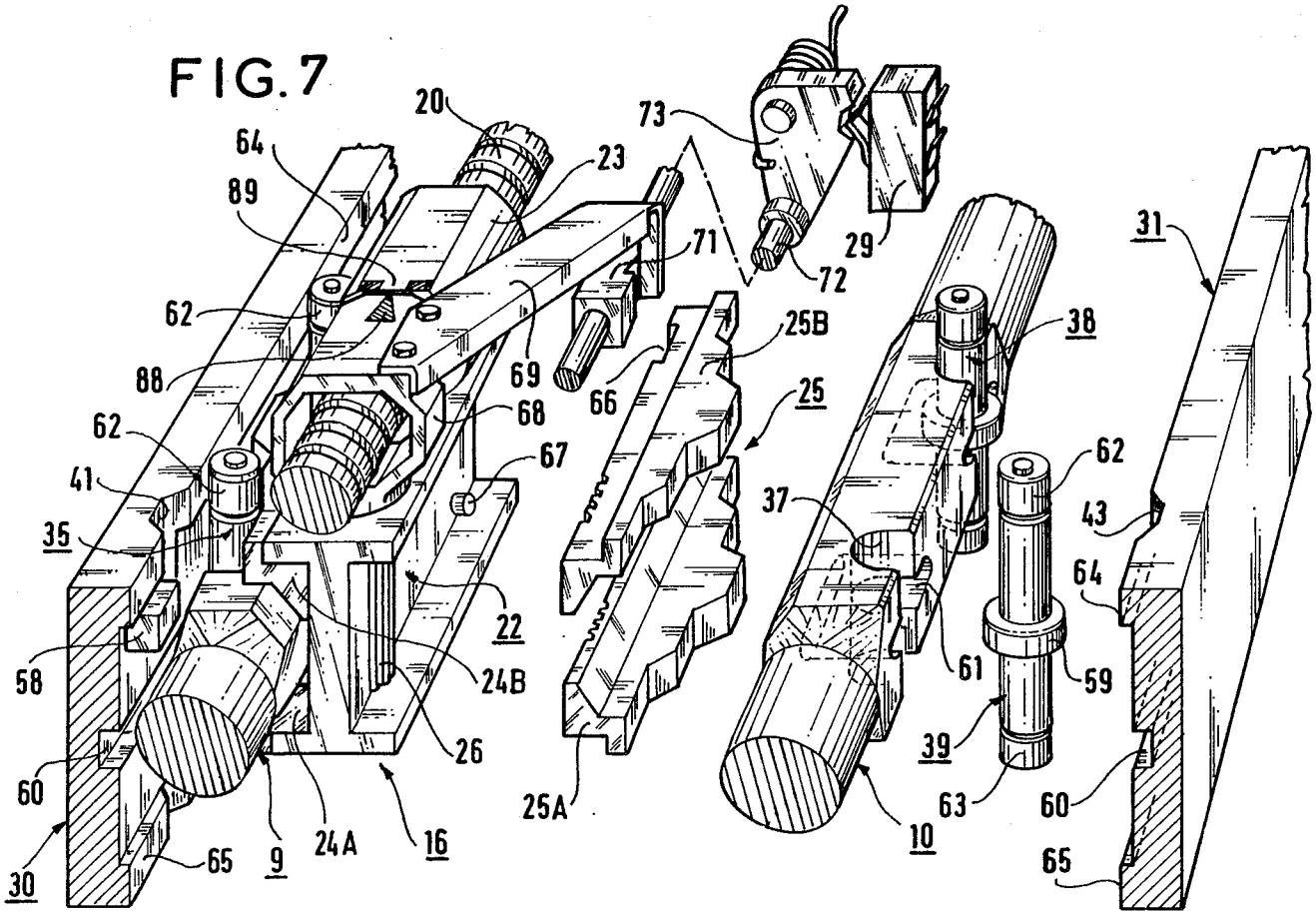
Figure 8:
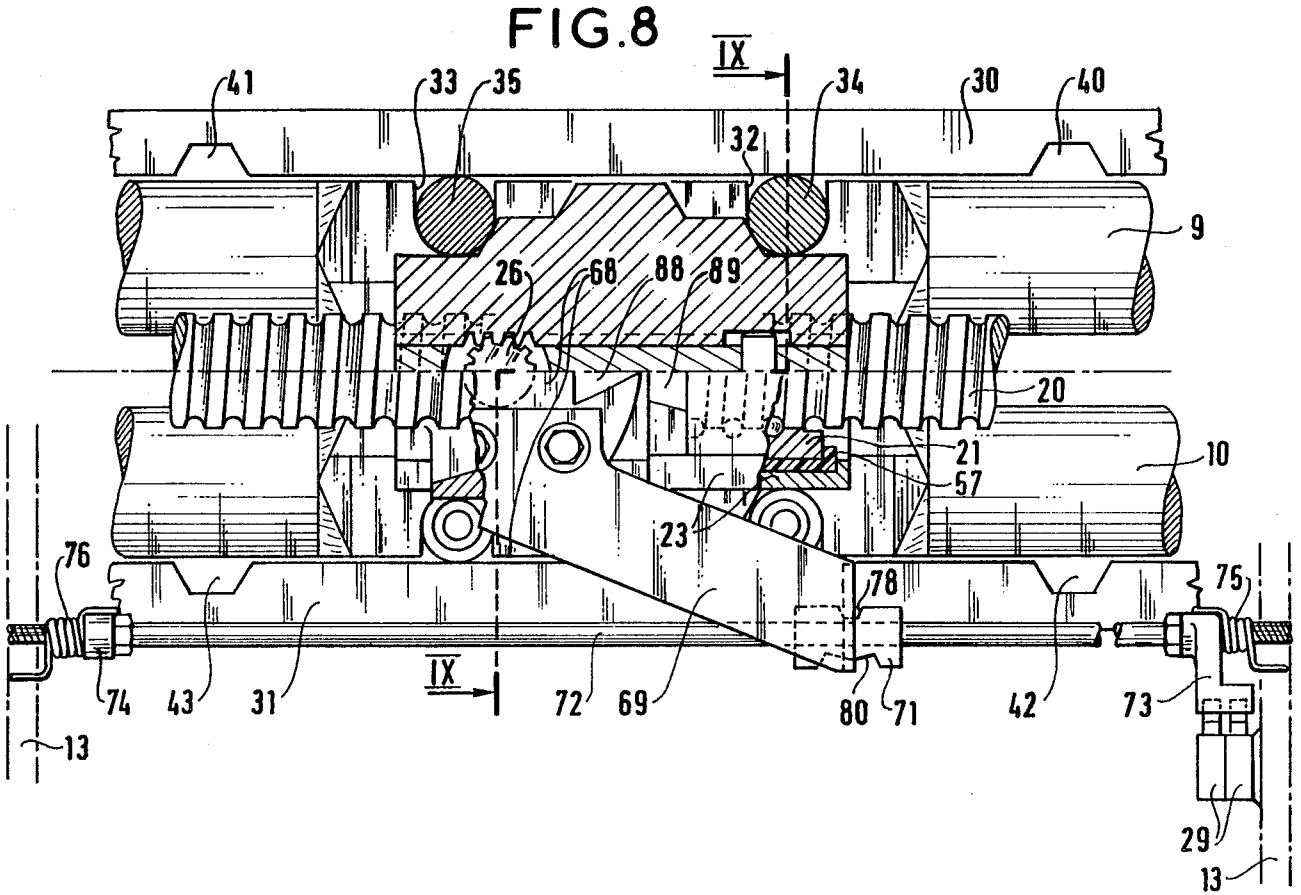
Figure 9:
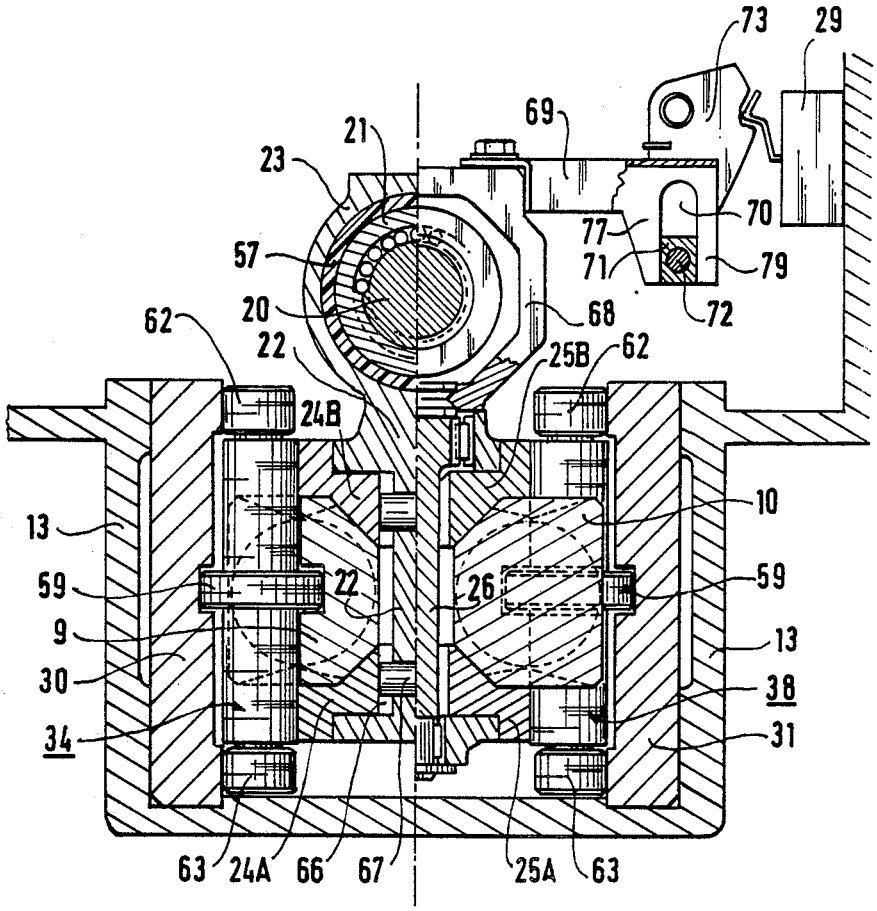
Figure 10:
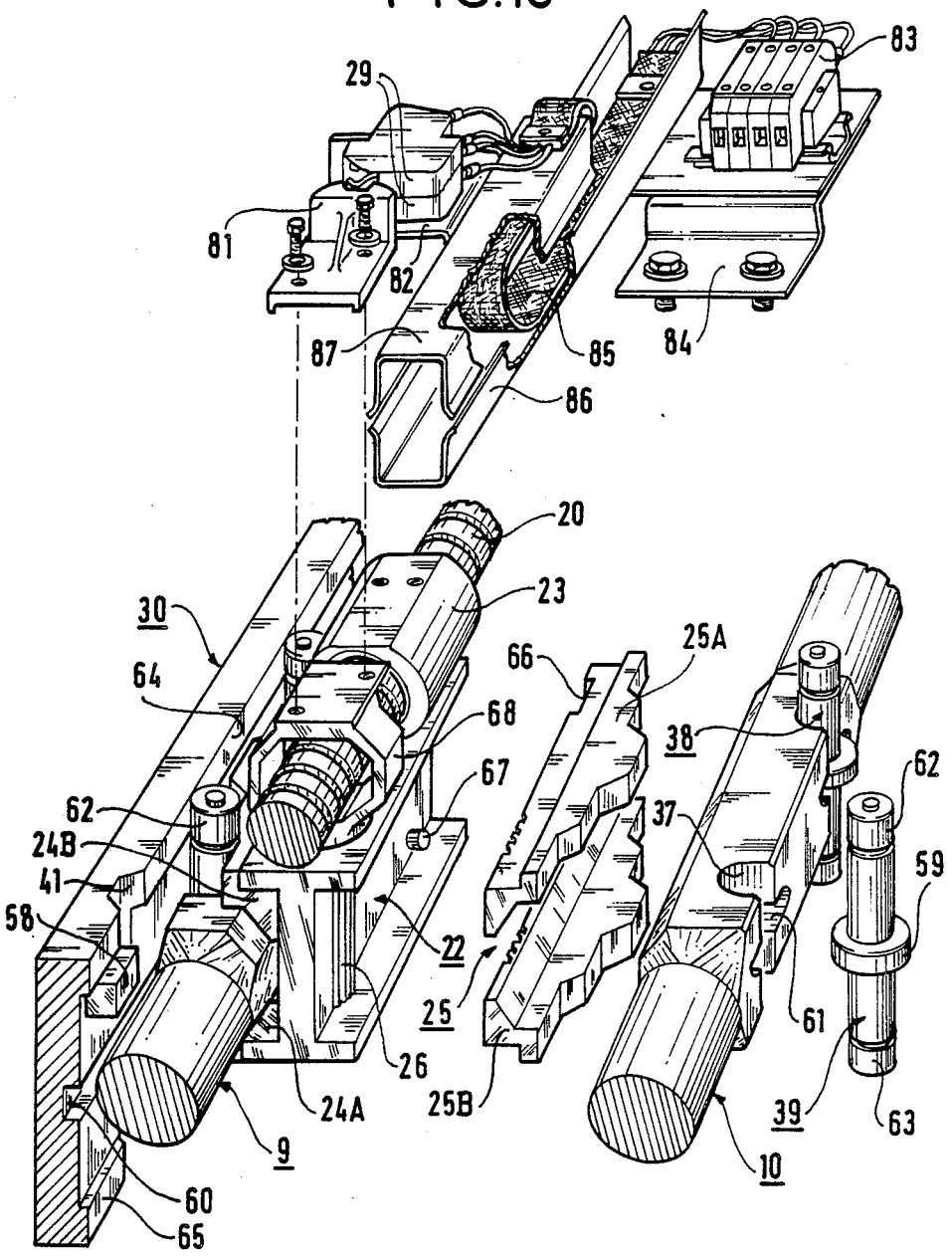
Figure 11:
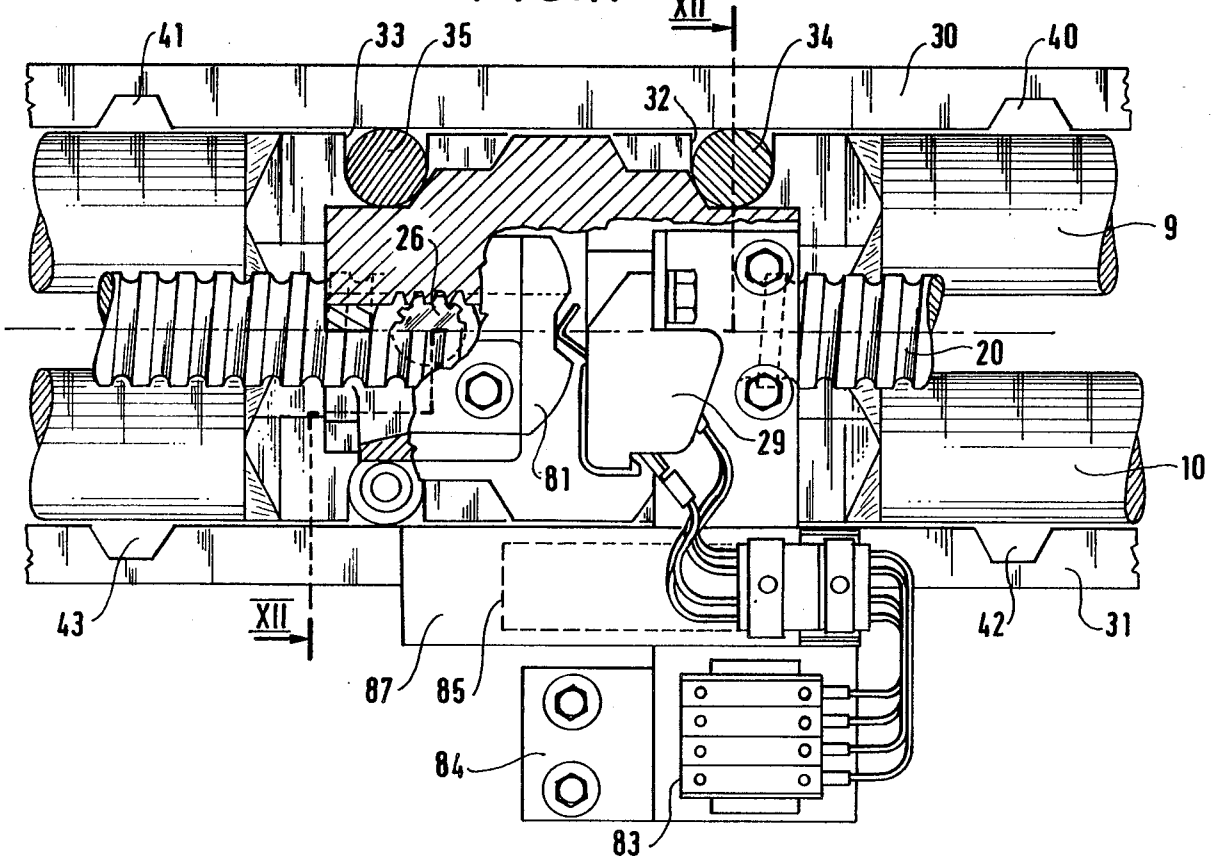
Figure 12:
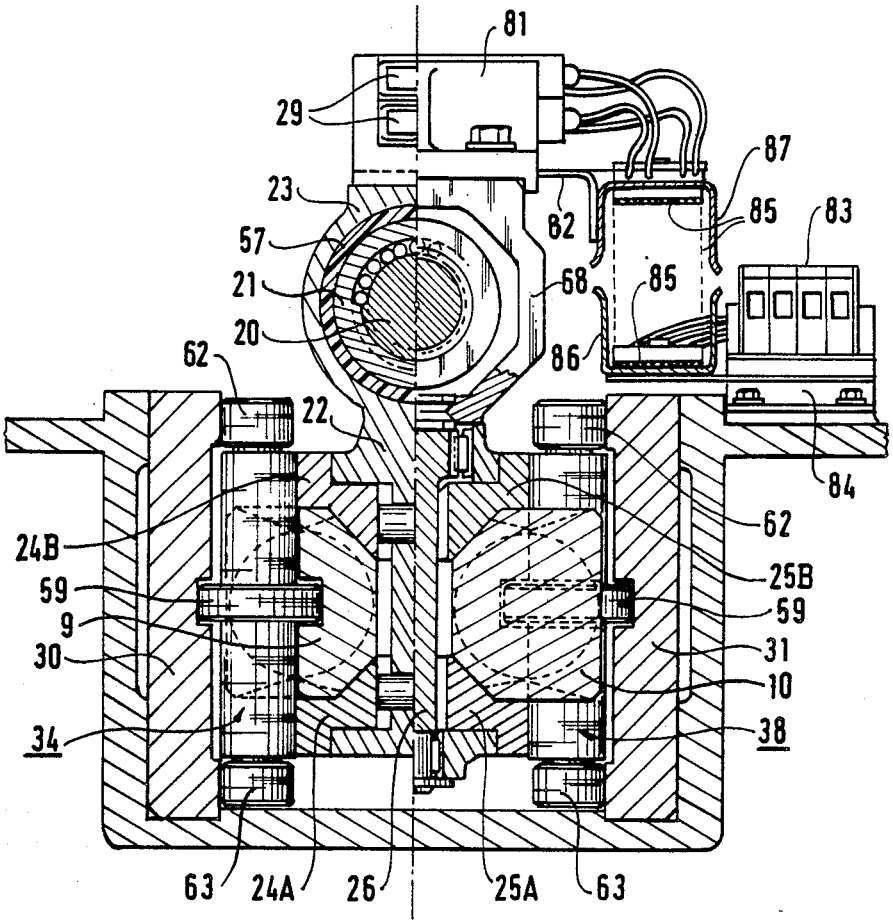

In above FIGS. 1 to 6, the moving equipment and the fault detector are shown in simplified form;

FIG. 7 is an exploded perspective view of a portion of the motor system, showing essentially the moving equipment, the fault detector, and the locking plates in a first embodiment of the invention;

FIG. 8 is a view of a fragment of the system shown in FIG. 7, as seen from above;

FIG. 9 is a section view on IX—IX of FIG. 8;

FIG. 10 is a view similar to FIG. 7 but showing a second, and preferred, embodiment of the invention;

FIG. 11 shows a portion of the FIG. 10 preferred embodiment as seen from above; and FIG. 12 is a view on XII—XII of FIG. 11.

MORE DETAILED DESCRIPTION

With reference initially to FIGS. 1 to 6, the system is described as a whole, together with its theory and its operation.

Figure 1:
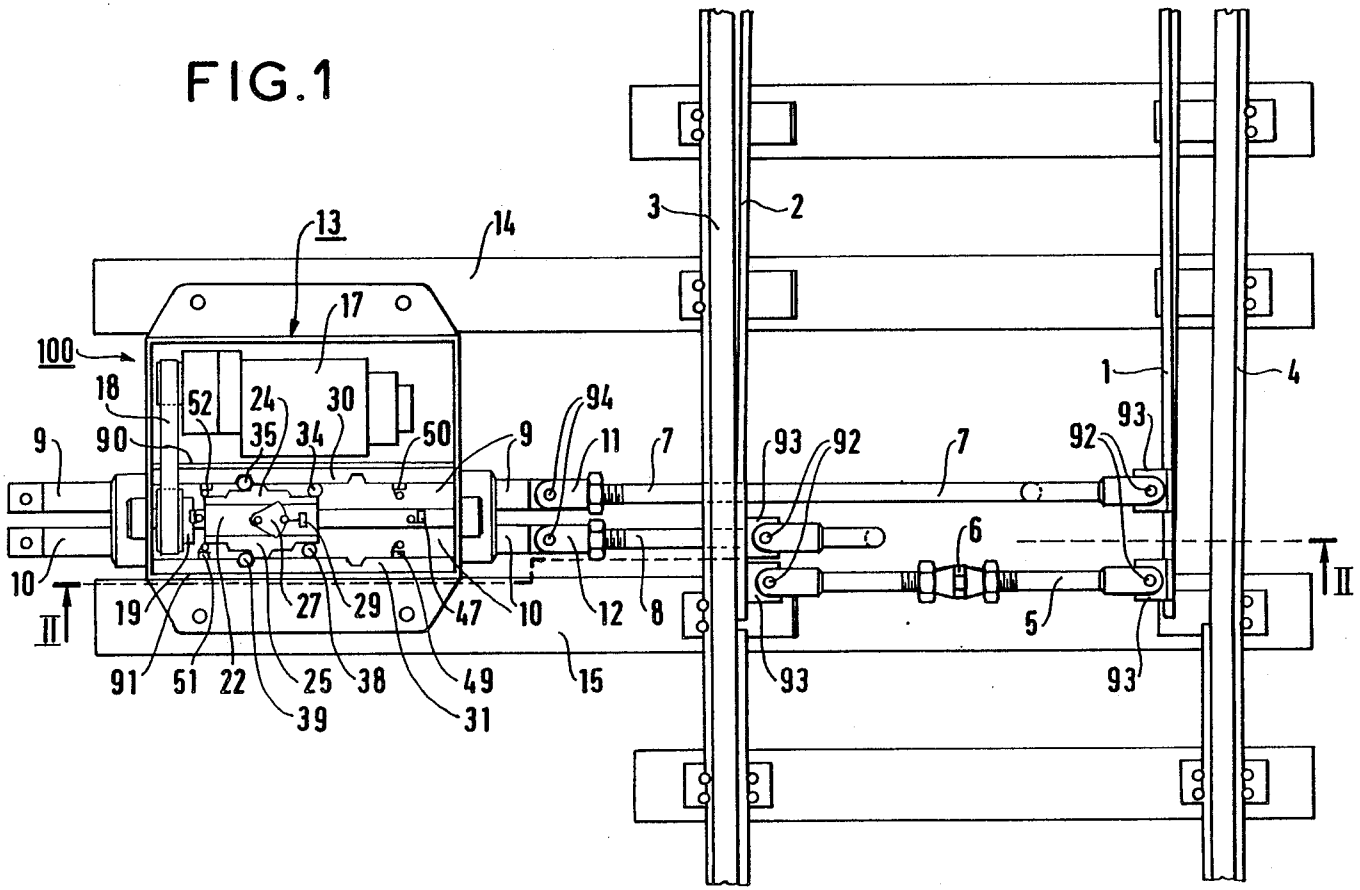
FIG. 1 is an overall view of a railroad switch motor system in accordance with the invention.
Figure 2:
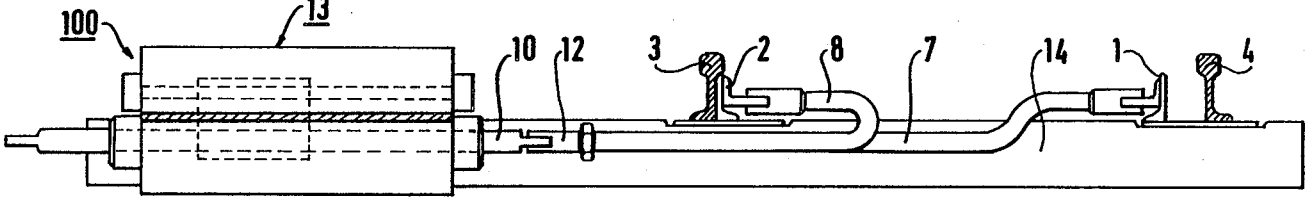
FIG. 2 is a view on II—II of FIG. 1.
Figure 3:
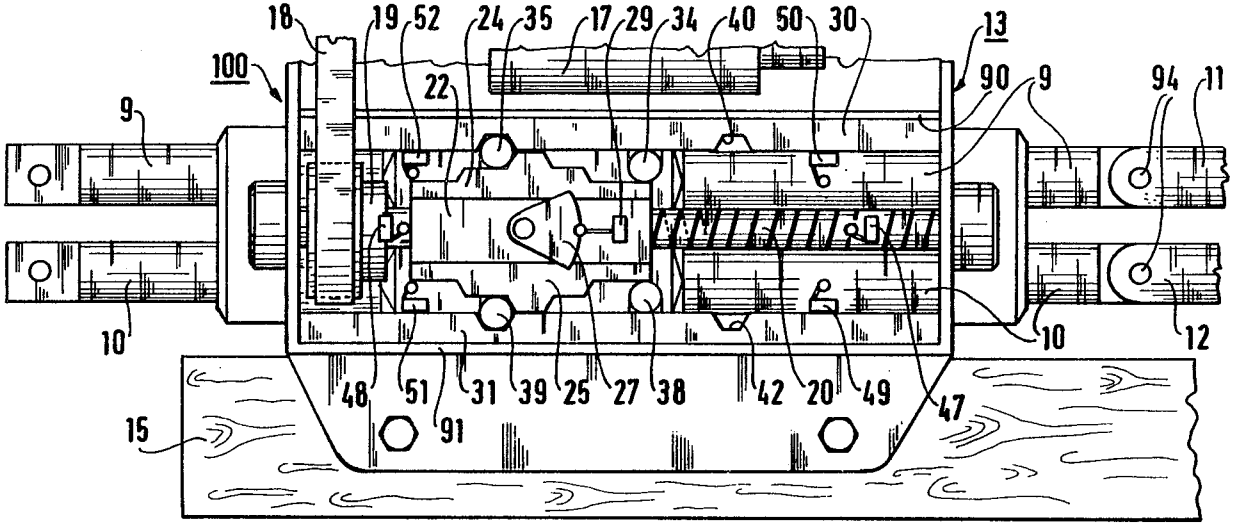
FIG. 3 is a view on a larger scale showing a portion of FIG. 1.

FIG. 1 shows a portion of a railroad switch including a right point blade 1 and a left point blade 2. The switch shown corresponds to a track branching off to the right and it is shown in its position corresponding to traffic being diverted from the straight to the branch when the switch is used as a facing switch or to passing traffic from the branch to the straight when the switch is used as a trailing switch. The left point blade 2 is therefore touching the straight backing rail 3 while the right point blade 1 is not touching its backing rail, i.e. it is at a distance from the backing rail 4 which begins the branch track going off to the right.

Near their tips, the point blades 1 and 2 are interconnected by a spacer bar 5 including a turnbuckle device 6 for adjusting their spacing.

A right operating rod 7 is connected perpendicularly to the right point blade 1 in the vicinity of its tip, and similarly a left operating rod 8 is connected perpendicularly to the left point blade 2 in the vicinity of its tip.

In order to operate the point blades 1 and 2 by means of the operating rods 7 and 8, the assembly includes a motor system 100 which is connected to the operating rods by a right control bar 9 connected to the right operating rod 7 and by a left control bar 10 connected to the left operating rod 8. The control bars 9 and 10 are fixed to the operating rods 7 and 8 and are disposed in line therewith by means of forks 11 and 12 enabling the transmission length to be adjusted. The control bars are integral parts of the motor system 100 of the invention.

The motor system 100 as a whole is situated in a housing 13 which is securely fixed to two ties or sleepers 14 and 15 which extend beyond the track.

The motor system includes motor means providing longitudinal, i.e. axial, drive to the right and left control bars 9 and 10 via a moving equipment 16. These motor means include a motor and gear box unit 17 which rotates a ball screw 20 via a belt 18 and a torque limiter 19, the ball screw 20 being fixed axially and co-operating with a nut 21 which is fixed to a central body 22 of the moving equipment 16. The nut 21 of the ball screw 20 is received in a nut cage 23 which is fixed to the central body 22.

In simplified FIGS. 1, 2, 4, 5, and 6, the transmission system comprising the ball screw 20 and the nut 21 is not shown. The screw 20 is visible, on its own, in FIG.

3. These items are shown, however, in FIGS. 7 to 12 which show practical embodiments of the invention.

Figures 5, 6A, 6B, 6C, 6D, 6E:
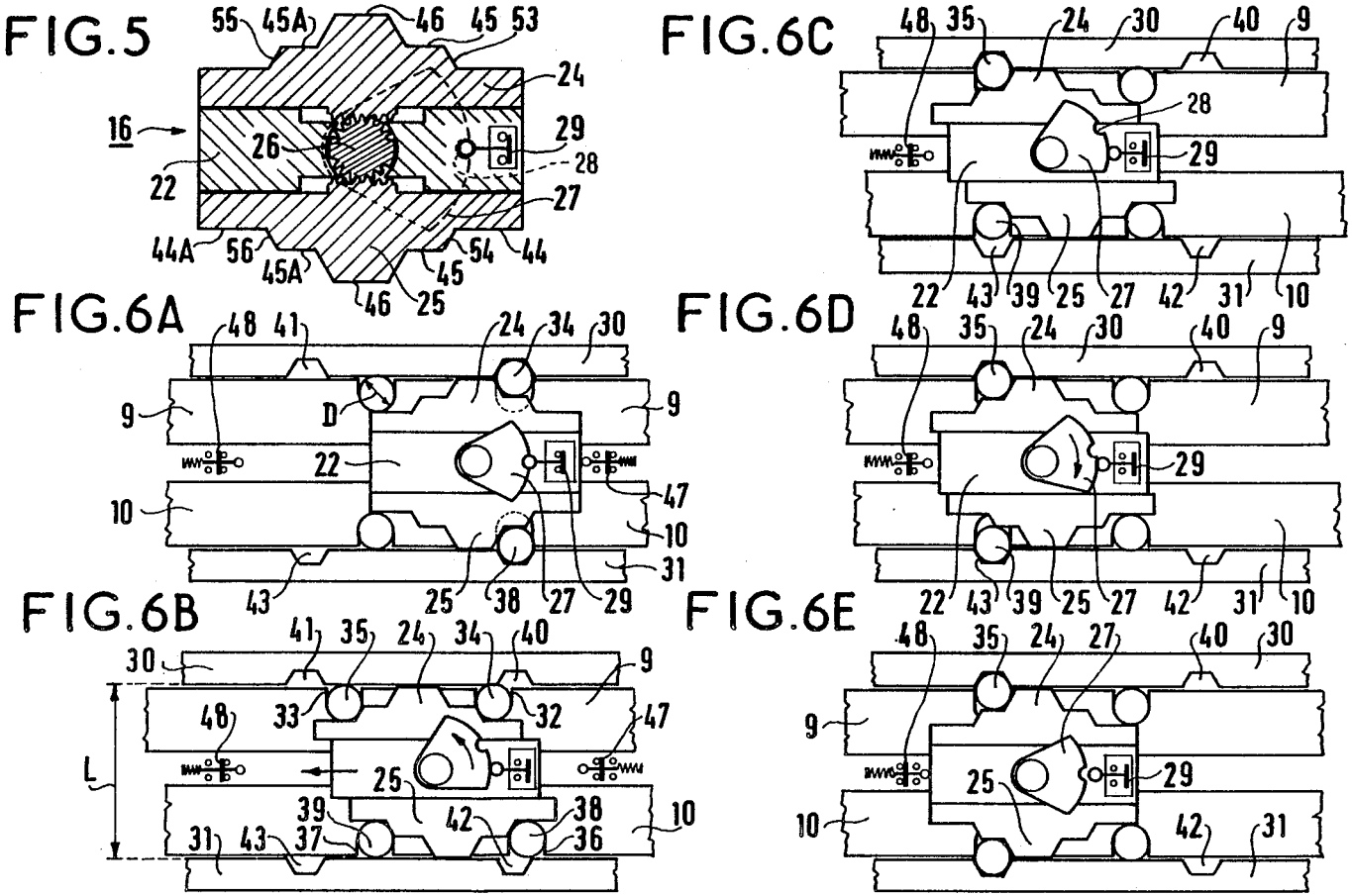
FIG. 5 is a simplified view of the fault-detecting moving equipment.
FIGS. 6A to 6E are diagrams illustrating the operation of the system in the event of a transmission fault as shown in FIG. 4.

For the time being, the important point is that these means together serve to drive the central body 22 of the moving equipment 16 in the longitudinal direction, i.e. parallel to the axes of the controls bars 9 and 10, with said moving equipment 16 being shown diagrammatically in FIG. 5 as removed from the mechanism assembly.

With reference to FIG. 5, the moving equipment 16 comprises a central body 22 which is driven longitudinally as mentioned above, and lies between a right longitudinal slide 24 and a left longitudinal slide 25. These two slides mesh with a common gear wheel 26 which is mounted free to rotate inside the central body 22. The gear wheel 26 is fixed to a member which is represented in said simplified FIGS. 1, 3, 4, 5, and 6 as a sector 27 which is provided with a notch 28 for co-operating with an electrical contact 29 for detecting anomalies, thereby making it possible to detect any rotation of the gear wheel 26 which would be indicative of a fault, e.g.: a broken component, a twisted component, or a fixing that has worked loose, relating to any of the components involved in the operating linkage for moving the point blades 1 and 2. This fault detection system related to rotation of the common gear wheel 26 is described in greater detail with reference to FIGS. 7 to 12 which show two specific embodiments of the invention.

As can be seen in FIG. 5, the strokes available to the right and left slides 24 and 25 relative to the central body 22 are limited by abutments. These abutments are described below with reference to FIGS. 7 and 10.

As can be seen in FIGS. 1, 3, 4, and 6, this moving equipment 16 is disposed in the fixed housing 13 between a right locking plate 30 and a left locking plate 31 both of which are fixed inside the housing 13. These locking plates are parallel to each other and to the control bars 9 and 10. In addition, the right control bar 9 is situated between the right locking plate 30 and said moving equipment 16 by being received in the right longitudinal slide 24. Similarly, the left control bar 10 is situated between the left locking plate 31 and the moving equipment 16 by being received in the left longitudinal slide 25. The right control bar 9 has two notches 32 and 33 which receive respective drive and locking pegs 34 and 35. These pegs are cylindrical, having vertical axes, and they are mounted "floating" between the right locking plate 30 and the right longitudinal slide 24. Similarly, the left control bar 10 also has two notches 36 and 37 which receive respective drive and locking pegs 38 and 39 which are mounted in the same way between the left locking plate 31 and the left longitudinal slide 25. Thus, each of the pegs 34, 35, 38, and 39 is prevented from moving in the axial direction of the corresponding control bar and must therefore move together therewith.

Finally, the right locking plate 30 includes two vertical locking grooves 40 and 41 having sloping side walls which flare apart from the bottom of the groove towards its opening which faces the right control bar 9. Similarly, the left locking plate 31 includes two vertical locking grooves 42 and 43 having sloping side walls which flare towards its opening facing the left control bar 10. The grooves 40 to 43 are not more than ½D deep, where D is the diameter of the floating pegs.

As shown in the figures, the width of the moving equipment 16 constituted by the distance between between the outside faces of the two slides 24 and 25 between the locking plates 30 and 31 is staged over three distinct widths and including, at each end of the moving equipment, a first stage 44 or 44A whose width is equal to the distance L between the two locking plates 30 and 31 less twice the diameter D of the floating pegs. This first stage is followed on each side towards the middle of the moving equipment by a second stage 45 or 45A whose width lies between L - 2D and L - D, and finally there is a central stage 46 whose width is greater than that of the second stage and is no greater than L. As can be seen in the figures, the transition between the first stage and the second stage takes place via a sloping wall.

The distance between the two notches in either of the control bars, e.g. the notches 32 and 33 is not less than the length of the central stage 46 plus the length of the two second stages 45 and 45A, but is not more than the length of the central stage 46 plus the length of one or other of the second stages 45 or 45A plus the length of one or other of the first stages 44 or 44A so as to ensure that the floating pegs are always situated between the moving equipment 16 and the locking plates 30 and 31, as can be seen in the figures.

End-of-stroke contacts 47 and 48 are actuated respectively at the end of a stroke to the right and at the end of a stroke to the left of the central body 22 of the moving equipment 16. When these contacts are actuated, the central body drive motor means are stopped. In addition, contacts 49, 50, 51, and 52 actuated by the slides 24 and 25 provide a check on the positioning and locking of the point blades 1 and 2 in both directions.

The device operates as follows: initially there are no faults, none of the components is broken or twisted, and the operating rods and control bars are properly fixed together and clamped in place with properly adjusted lengths. This is the situation shown in FIG. 1.

The left blade 2 is touching its backing rail and the right blade 1 is not touching its backing rail, and both blades are properly locked. Floating peg 35 is received simultaneously in its notch 33 in the bar 9 and in the groove 41 of the right locking plate 30, and it cannot escape therefrom since it is locked in place by the second stage 45A of the moving equipment 16. The same applies to floating peg 39. Thus, both control bars 9 and 10 are locked against motion in either direction by the pegs 35 and 39 which are partially received in the grooves 41 and 43 of the locking plates.

In order to put the switch in its other position, the motor and stepdown gear unit 17 is switched on, thereby rotating the ball screw 20 and thus driving the central body 22 of the moving equipment 16 to the right. This displacement of the central body 22 causes the slides 24 and 25 to be driven simultaneously by the gear wheel 26 until the sloping flanks 53 and 54 (FIG. 5) of the slides 24 and 25 bear against the drive and lockings pegs 34 and 38. Thereafter, since none of the links is faulty, since the mechanical linkage is not broken, and since the two point blades 1 and 2 are rigidly interconnected by the spacer bar 5, continuing motion causes the pegs 34 and 38 to drive the right and left control bars 9 and 10 to the right thus bringing the blades 1 and 2 with them and the gear wheel 26 is prevented from rotating. The movement stops when the central body 26 reaches the end of stroke contact 47. At that moment, the assembly is in the position shown in FIG. 6A. The contacts 49 and 50 are actuated indicating that the control bars 9 and 10 are properly positioned and locked by the pegs 34 and 38 which are held in place in the grooves 40 and 42 of the locking plates 30 and 31.

The right point blade 1 is thus touching its backing rail 4 and the left point blade 2 is thus open, i.e. in the opposite position to that shown in FIG. 1. The contact 29 for checking anomalous operation has not moved.

Figure 4:
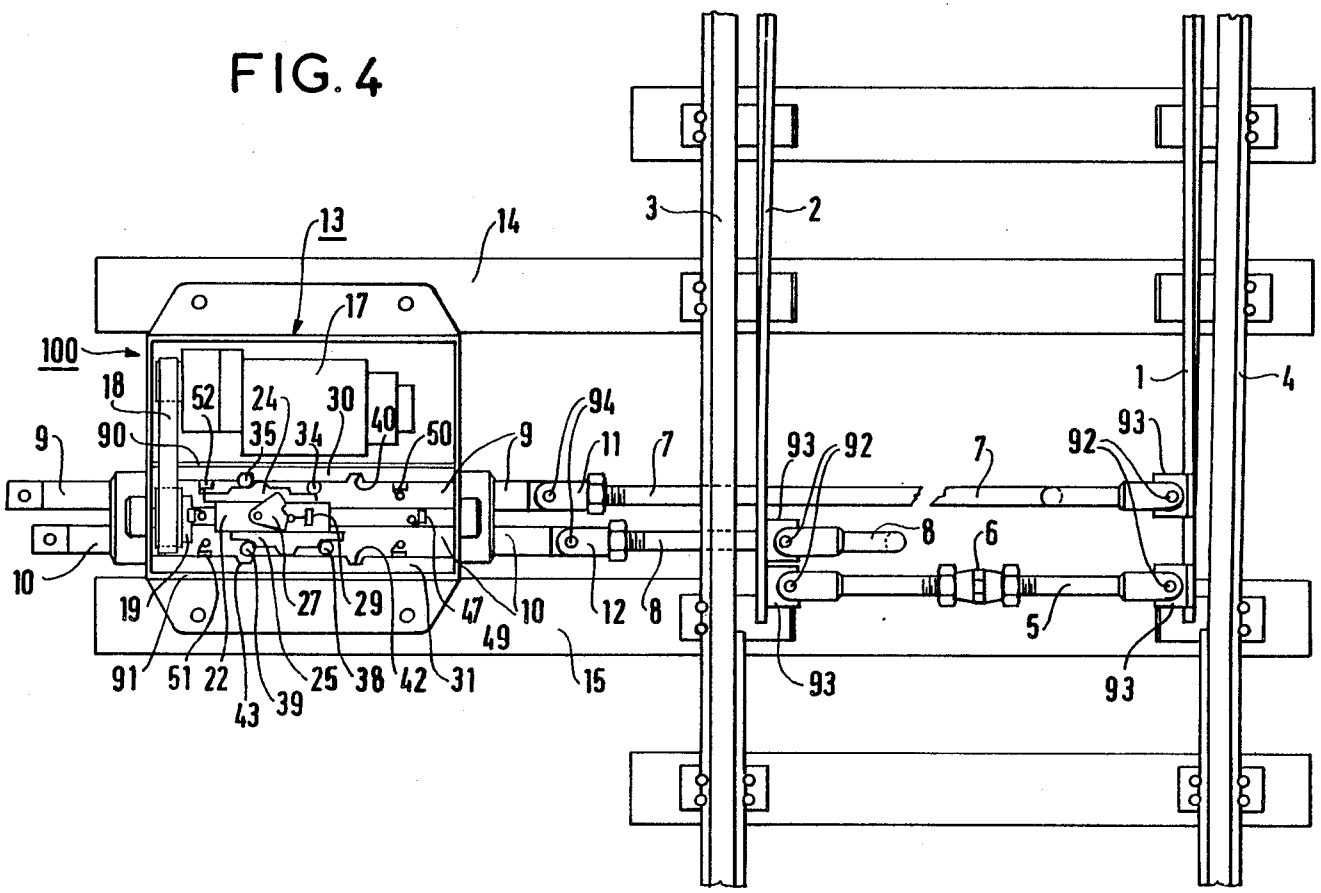
FIG. 4 is a view similar to FIG. 1, but showing the operating rod of the right point blade as being broken.

Second case: assume that there is a fault in the transmission of motion. For example assume that the right operating rod 7 is broken, as shown in FIG. 4.

Initially, the right point blade 1 is touching its backing rail 4 and the left point blade 2 is open, with the moving equipment being in the position shown in FIG. 6A.

The switch is to be moved into its other position so as to return to the position shown in FIG. 1. The motor and stepdown gear unit 17 is thus turned on to drive the central body 22 to the left. The entire moving equipment 16 is driven by this motion and no relative displacement occurs between the slides 24 and 25 and the central body 22 until the sloping flanks 55 and 56 (FIG. 5) of the slides 24 and 25 come into abutment against the drive and locking pegs 35 and 39. Thereafter, since the rod 7 is broken, the linkage is broken and the force on the control bar 9 is much less than the force on the left control bar 10, thereby causing the gear wheel 26 to act as a differential and only the slide 24, is driven driving only the right control bar 9. This movement continues until the right slide 24 comes into abutment against the central body 22. The system is then in the position shown in FIG. 6B. The sector 27 has rotated anticlockwise and the contact 29 for checking anomalous operation has been operated. The motion continues, and since the slides are now in end-of-stroke abutment relative to the central body 22, the entire moving equipment 16 moves to the left until the drive and locking peg 35 is locked in the locking groove 41, thereby locking the control bar 9. This is the position shown in FIG. 6C. As motion continues, only the central body 22 and the left slide 25 continue their stroke, thus driving control bar 10 and the entire railroad switch: i.e. the right blade 1 and the left blade 2 by virtue of the left control bar 10 and the spacer bar 5. During this motion, the central body 22 and the left slide 25 catch up the right slide 24. This gives rise to the position shown in FIG. 6D and then the position shown in FIG. 6E at the end of the stroke, with the end-of-stroke contact 48 being actuated. The sector 27 has returned to its middle position but the contact 29 for checking anomalous operation remain in its fault-indicating position and must be reset manually. The contacts for checking positioning and locking 51 and 52 (FIG. 3) will have been actuated, but the presence of a fault continues to be indicated by the contact 29.

The switch has nevertheless operated properly and is now locked by means of the left control bar 10 and the spacer bar 5. Before one of the two point blades 1 and 2 can occupy a wrong position or fail to be locked in position, it is necessary for there to be a fault simultaneously in two different components: one in the right transmission linkage and the other in the left transmission linkage, or else one in one or other of the two transmission linkages and the other in the spacer bar 5. Nevertheless, a fault is still indicated by the contact 29 regardless of the nature of the fault and regardless of which portion of the linkage is faulty, including the fixing of the housing 13 on the sleepers 14 and 15.

It may be observed that the sector 27 is offset so that it points towards the portion of the frame or the operating linkage which is faulty, thereby making it easier to find a fault, particularly when the fault is not very obvious such as a part coming unscrewed, for example.

FIGS. 7, 8, and 9 show a practical embodiment of the main parts of the system constituting a first embodiment of a fault detection system co-operating with the contact 29 for detecting anomalous operation. A first important point: the contact comprises two contacts 29 since as a safety precaution, a contact is disposed both in the positive wire and in the negative wire of the electrical circuit.

The central body 22 can be seen to have an I-shaped section. The right and left longitudinal slides 24 and 25 are each constituted for practical implementation reasons by two half-slides: 24A and 24B for the right slide 24; and 25A and 25B for the left slide 25. Each half slide thus includes a rack portion which meshes with the common gear wheel 26 which is integrated in the central body 22.

As can be seen in the figures, the ball screw 20 drives the central body 22 axially by means of a nut 21 mounted in a nut cage 23 which is fixed to the central body 22. The nut 21 is mounted in the cage by means of a resilient ring 57.

FIG. 7 shows an anti-overrun abutment 58 disposed immediately downstream from the locking groove 41 relative to the direction of advance of the moving equipment 16, said abutment 58 serving to ensure that floating peg 35 penetrates into the locking groove 41. A similar abutment 58 is likewise disposed downstream from each of the locking grooves.

In order to hold the floating pegs axially, i.e. vertically, each of them carries a collar 59 which penetrates both into a groove 60 in the associated locking plate and into an enlarged portion 61 of the notch in which it is received in one or other of the control rods 9 and 10.

Finally, it can be seen that the drive and locking pegs include running wheels 62 and 63 at each end which run (outside the locking grooves 40 to 43) on forwardly projecting running paths 64 and 65 on the locking plates 30 and 31.

In order to limit the relative stroke between the slides 24 and 25 and the central body 22, each half-slide 24A, 24B, 25A, and 25B includes a recess 66 which receives a stud 67 carried by the central body 22. The central body 22 thus has four studs 67.

The fault detection means comprise initially a ring 68 fixed to the common gear wheel 26. This ring has an opening which is large enough to enable it to rotate to a certain degree together with the gear wheel in spite of the ball screw 20 passing through the ring.

The top portion of the ring has a side lever 69 fixed thereon with its end terminating by a portion extending vertically and including a notch 70 which receives a slide 71. The slide 71 is mounted to slide freely both axially and in rotation on a rod 72 disposed parallel to the axis of the screw 20. At each of its ends, the rod 72 is fixed to the end of a respective rocker 73 or 74 whose other end is hinged to rotate relative to the housing 13. The rocker 73 constitutes a cam which co-operates with the contacts 29 for detecting an anomaly. The cam-rocker 73 co-operates with the contacts 29 for both rocking directions of the rod 72, i.e. in both directions of rotation of the ring 68. The rockers 73 and 74 are provided with springs 75 and 76 which exert a small of force tending to rock the rod 72 and to actuate the contacts 29 by means of the cam-rocker 73 in the event of a fault in the way the lever 69 is fixed to the ring 68.

This provides safety by ensuring that a fault is signalled even when the fault is on the fault detection device. Two springs 75 and 76 are used rather than just one spring for the same reasons of safety and redundancy.

In normal operation, i.e. in the absence of a fault, the ring 68 does not pivot and displacement of the moving equipment 16 causes the slide 71 to slide along the rod 72 by virtue of the lever 69, however the rod does not rock since the lever does not pivot. The slide 71 is driven by the portion 77 of the vertical portion of the lever 69 which penetrates into a small notch 78 of the slide. On the other side 79, the vertical portion of the lever 69 is situated in a rounded recess 80 of the slide 71 enabling the lever to rotate together with its ring 68 in the event of a fault, but without jamming. If this occurs, pivoting of the lever 69 to the right or to the left causes the rod 72 to rock to the right or to the left and thus moves the cam-rocker 73 which actuates the contact 29. During this movement, the slide 71 is also rotated to a small extent relative to the rod 72.

FIGS. 10, 11, and 12 show an embodiment of the invention having a preferred fault detection device, while the other portions thereof are the same. In the exploded perspective view of FIG. 10, the lefthand locking plate 31 has been omitted in order to leave more room in the drawing.

The common gear wheel 26 is still fixed to the ring 68, but a cam 81 is fixed directly to the ring 68 and co-operates directly with the contacts 29 which are no longer fixed in stationary manner on the housing 13 but are now fixed to the nut cage 23 of the ball screw by means of a fixing bracket 82. Since the contacts 29 are fixed on the nut cage 23 which is in turn fixed to the central body 22, i.e. to a moving part, the information provided by the contacts is conveyed to a fixed terminal strip 83 which is fixed to the housing 13 by means of a fixing plate 84. The electrical connection between the contacts 29 and the fixed terminal strip 83 is provided by a tape of conductors 85, which tape is protected by a fixed bottom trough 86 which is fixed to the plate 84 and by a sliding top trough 87 which is fixed to the central body 22 by the bracket 82. Naturally, the concave side of the top trough 87 faces downwards.

Visual verification that the rods and bars 7, 8, 9, and 10 are properly adjusted in length is performed directly by observing the cam 81 controlling the contacts 29.

In FIGS. 7, 8, and 9, the ring 68 is marked with an arrow 88 and the nut cage 23 has a reference zone 89 (see FIGS. 7 and 8) enabling such adjustment to be performed. The zone 89 has a range of widths corresponding to proper adjustments over which the fault contacts 29 will not be operated.

Overall, the motor and checking system has intrinsic safety which ensures that all of the operating and locking functions applicable to the point blades are performed while simultaneously checking the real positions of the blades and indicating any faults.

The system also makes it possible to perform two functions using a single member: a single part, i.e. each of the floating pegs, serves to provide both drive and locking. Thus, locking necessarily takes place if the movement is performed all the way to the proper position. This is not the case in current systems where it is possible to move point blades without locking them in position, e.g. in the event of a broken component.

In the locked position, the control bars 9 and 10 are locked in both directions, and any axial force that may be applied thereon is transformed, by the floating pegs, into transverse and longitudinal force on the locking plates 30 and 31 which are easily held firmly in the housing 13, without any axial force being applied to the moving equipment 16. The system is thus extremely robust.

The locking plate 30 bears, for example, on a spacer 90 which is dimensioned to meet the maximum expected amount of force, as is the locking plate 31 which bears against the edge 91 of the housing. The plates 30 and 31 are fixed against the abutments 90 and 91.

In addition, since locking is provided by a cylindrical peg pinched between two other members, a large shear area is obtained using floating pegs of small dimensions.

The contacts 29 for checking anomalous operation are constituted either by contacts which, once they have been actuated, do not return to their rest position automatically but require moving to said position manually, or else by contacts which do return automatically when no longer actuated, but which are used to actuate a relay which in turn requires resetting manually. In either event, the fault indication persists until manual intervention has occurred.

Finally, it can be seen that the invention makes it possible to provide all of the required functions with intrinsic safety by means of a motor and checking system which requires only two control bars.

As explained above, it relies on the principle of inserting an item ("differential" moving equipment 16 and the device for detecting rotation of the gear wheel 26) between two different operating and locking linkages each of which is sufficient for ensuring safety, said elements verifying that all of the items and assemblies in the two linkages are in good condition each time they are operated, said linkages being constituted by:

- the floating pegs which provide drive and locking;
- the control bars 9 and 10;
- the operating rods 7 and 8;
- the spacer bar 5;
- the length adjustments 6, 11, and 12; and
- the pins 92 and the fixing plates 93 connecting the rods 7 and 8 and the spacer bar 5 to the point blades 1 and 2, and also the fixing pins 94 connecting the rods 7 and 8 to the bars 9 and 10.

Finally, the device is also capable of verifying that the housing 13 is properly fixed to the ties or sleepers 14 and 15.

I claim:

1. A motor system for a railroad switch constituted by two moving blades: a right point blade and a left point blade, said two blades being interconnected in the vicinity of their tips by a spacer bar, the right point blade being connected in the vicinity of its tip to a right operating rod, the left point blade being connected in the vicinity of its tip to a left operating rod, wherein the system includes motor means for longitudinally driving a right control bar and a left control bar which are respectively connected to and in line with the right operating rod and the left operating rod, said motor means and said control bars being disposed in a housing disposed in a fixed position, the system including, inside said housing, moving equipment including a central body lying between a right longitudinal slide and a left longitudinal slide, the two slides meshing with a common gear wheel mounted to rotate freely in said central body, the strokes of the two slides relative to said central body being limited by abutments, said motor means acting on said central body of the moving equipment, which body is movable in parallel between a right locking plate and a left locking plate which are fixed and which are parallel to each other and to the axes of said control bars, the right control bar being situated between the right locking plate and said moving equipment by being at least partially received in said right longitudinal slide, the left control bar being situated between the left locking plate and said moving equipment by being at least partially received in said left longitudinal slide, each control bar being provided with two drive and locking pegs, which pegs are cylindrical, and disposed vertically in a floating mount, each being received between a locking plate and a slide in a notch provided in a corresponding one of the control bars, each locking plate including two vertical locking grooves having sloping side walls which flare apart going from the plate towards the bar, and having a depth of not more than one half the diameter $\frac{1}{2}D$ of one of said floating pegs, wherein the width of said moving equipment constituted by the distance between the outer flanks of the two sides, between the two locking plates is staged over three distinct widths comprising, at each end, a first stage of width no greater than the distance L between the two locking plates less twice the diameter D of a floating peg, followed on each side of said moving equipment going towards the middle of the moving equipment by a second stage of width lying between L - 2D and L - D, and finally a central stage of width less than L and greater than the width of said second stage, with the transition from the first stage to the second stage being formed by a sloping wall, the distance between the two notches of a control bar being not less than the length of the central stage plus twice the width of one of second stages, and being less than the length of the central stage plus the length of one of the second stages plus the length of one of the first stages, and wherein said common gear wheel is connected to detector means which co-operate with an electrical contact for checking anomalous operation causing said gear wheel to rotate, thereby indicating a fault.

2. A system according to claim 1, wherein each floating peg includes a running wheel at each of its ends and co-operating, outside said grooves by running over the adjacent locking plate.

3. A system according to claim 1, wherein each locking plate includes an anti-overrun abutment for said floating peg in the immediate vicinity of each of said grooves, and downstream therefrom relative to the direction of displacement of the moving equipment towards said groove.

4. A system according to claim 1, wherein each floating peg is held axially by a collar fixed to the peg and having a greater diameter than the peg, said collar penetrating firstly into a longitudinal groove in the locking plate associated with the peg under consideration, and secondly into an enlarged portion of said notch receiving the peg in one of the control bars.

5. A system according to claim 1, wherein said motor means comprise a ball screw co-operating with a nut which is fixed to said central body of said moving equipment, the ball screw being rotated by a motor and step-down gear unit via a torque limiter.

6. A system according to claim 5, wherein said means for detecting rotation of said common gear wheel comprise a ring fixed to rotate with said common gear wheel, said ring having said ball screw passing therethrough and having an opening which is large enough relative to the diameter of the screw to allow the ring a certain amount of freedom to rotate with the gear wheel.

7. A system according to claim 6, wherein the top portion of the ring includes a cam which co-operates with at least one contact fixed on a nut cage for the nut of the ball screw, said cage being fixed to said central body, with the information provided by said contact being conveyed to a fixed terminal strip which is fixed to said housing via a tape of conductors, said tape being protected by a fixed bottom trough which is connected to the housing and by a sliding top trough whose concave face is directed downwards and which is fixed to said central body.

8. A system according to claim 6, wherein the said ring carries a lateral lever co-operating via a slide with a rod running parallel to said screw and to said control bar, said rod being fixed at each of its ends to the end of a rocker which is hinged at its other end to said housing, with one of the two rockers including a cam co-operating with at least one switch situated in a fixed position, said slide sliding freely over said rod and being engaged in a fork at the end of said lateral lever.

9. A system according to claim 1, wherein the right longitudinal slide and the left longitudinal slide are both constituted by two longitudinal half-slides with each control bar being placed between a respective pair of said half-slides.

10. A system according to claim 1, including end-of-stroke contacts for said moving equipment.

* * * * *